US006510852B1

(12) United States Patent
Shiery et al.

(10) Patent No.: US 6,510,852 B1
(45) Date of Patent: Jan. 28, 2003

(54) HEADPIECE FOR PATIENT SUPPORT

(75) Inventors: Jeffrey C. Shiery, East Leroy, MI (US); Stanley T. Palmatier, Paw Paw, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/047,743

(22) Filed: Jan. 15, 2002

(51) Int. Cl.[7] ..... A61G 15/00
(52) U.S. Cl. ..... 128/845; 128/870
(58) Field of Search ..... 128/869, 870, 128/845; 602/5, 32; 5/625, 628, 636, 637

(56) References Cited

U.S. PATENT DOCUMENTS 4,035,953 A * 7/1977 Bierlich ..... 49/192
5,177,823 A * 1/1993 Riach ..... 5/636
5,524,639 A * 6/1996 Lanier ..... 128/845
5,916,189 A * 6/1999 Sullenperger et al. ..... 602/36

OTHER PUBLICATIONS

Drawing of Stryker Medical 1069 Headpiece, May 1999, 1 page.

Photo of Stryker Medical 1069 Headpiece, 1 page.

* cited by examiner

*Primary Examiner*—Michael A. Brown
(74) *Attorney, Agent, or Firm*—Flynn, Thiel, Boutell & Tanis, P.C.

(57) ABSTRACT

A headpiece for providing support to the head of a patient includes neck and head support plates. The neck support plate is pivotally attached to a surgical table and is pivotal about a neck support plate axis. A head support plate is pivotally attached to the neck support plate and is pivotal with respect to the neck support plate about a head support plate axis. A first lever is pivotally attached to the head support plate. A first locking mechanism moves between locked and released positions when the first lever pivots. The head support plate can pivot with respect to the neck support plate when the first locking mechanism is in the released position. A second lever includes a first arm pivotally attached to the head support plate and configured to pivot about a second axis and a second arm pivotally attached to the neck support plate and configured to pivot about a third axis. The first arm pivots with respect to the second arm in response to pivoting of the head support plate. A flange extending from the first arm intermediate the second and third axes can engage a tab extending from the second arm so the second arm will pivot in response to pivoting of the first arm pivots.

4 Claims, 6 Drawing Sheets

HEADPIECE FOR PATIENT SUPPORT

FIELD OF THE INVENTION

This invention relates generally to a headpiece for patient support and, more particularly, to a headpiece including a head support plate and a neck support plate, wherein the head support plate is configured to pivot with respect to the neck support plate and the neck support plate is configured to pivot with respect to a surgical table to which the headpiece is attached.

BACKGROUND OF THE INVENTION

In the operating room, it is sometimes desirable for a surgeon to re-orient the head of a patient with respect to the patient's neck. Similarly, it is sometimes desirable for the neck of the patient to be re-oriented with respect to the patient's body. For this purpose, an adjustable headpiece is typically attached to the surgical table to support the head of the patient. The headpiece preferably has the capability to allow both the head and the neck of the patient to be reoriented to the desired position while being sufficiently sturdy to support the head and neck of the patient during the surgical procedure.

Adjustable headpieces are currently available for attachment to surgical tables. These headpieces include a head support plate that is pivotally attached to a neck support plate. The headpiece is configured for attachment to a surgical table so that the neck support plate can pivot with respect to the surgical table. While current adjustable headpieces offer flexibility for positioning the patient for surgical procedures, further improvements can be made to these devices to increase their performance and ease of use. For instance, since these headpieces include a first support plate that pivots with respect to the second support plate, there have been difficulties in developing a reliable mechanism that allows for smooth releasing and locking of the plates in the desired positions.

SUMMARY OF THE INVENTION

This invention is directed to a new and useful headpiece for providing support to the head of a patient. The headpiece includes a neck support plate and a head support plate. The neck support plate has a first end configured for pivotal attachment to a surgical table and for movement about a neck support plate pivot axis. A second end of the neck support plate is pivotally attached to the head support plate so the head support plate is pivotal with respect to the neck support plate about a head support plate pivot axis. A first lever is pivotally attached to the head support plate and is configured to pivot about a first pivot axis between a first position and a second position. A first locking mechanism is configured for movement between locked and released positions. The first locking mechanism is configured to move to the locked position when the first lever is in the first position and to the released position when the first lever is in the second position. The head support plate is configured to be fixed with respect to the neck support plate when the first locking mechanism is in the locked position. The head support plate is additionally configured to be pivotable with respect to the neck support plate about the head support plate pivot axis when the first locking mechanism is in the released position.

The headpiece includes a second lever that has a first arm that is pivotally attached to the head support plate for pivotal movement about a second pivot axis between third and fourth positions. The second lever includes a second arm that is pivotally attached to the neck support plate for pivotal movement about a third pivot axis between fifth and sixth positions. The first arm is also pivotal with respect to the second arm in response to pivoting of the head support plate about the head support plate pivot axis. A flange extends from the first arm and is oriented intermediate the second and third pivot axes. A tab extends from a first end of the second arm. The flange is configured to engage the tab so the second arm will pivot about the third pivot axis when the first arm pivots about the second pivot axis. A second locking mechanism is included and is configured for movement between locked and released positions. The second locking mechanism is configured to move to the locked position when the second arm is in the fifth position and to the release position when the second arm is in the sixth position. A second end of the second arm is connected to the second locking mechanism and is oriented congruently with the neck support plate pivot axis. The neck support plate is configured to be fixed with respect to the surgical table when the second locking mechanism is in the locked position. The neck support plate is additionally configured to be pivotable about the neck support plate pivot axis when the second locking mechanism is in the released position.

BRIEF DESCRIPTION OF THE DRAWINGS

This invention is pointed out with particularity in the accompanying claims. The above and further features and benefits of this invention are better understood by reference to the following detailed description, as well as by reference to the following drawings in which:

DETAILED DESCRIPTION

Figure 1:
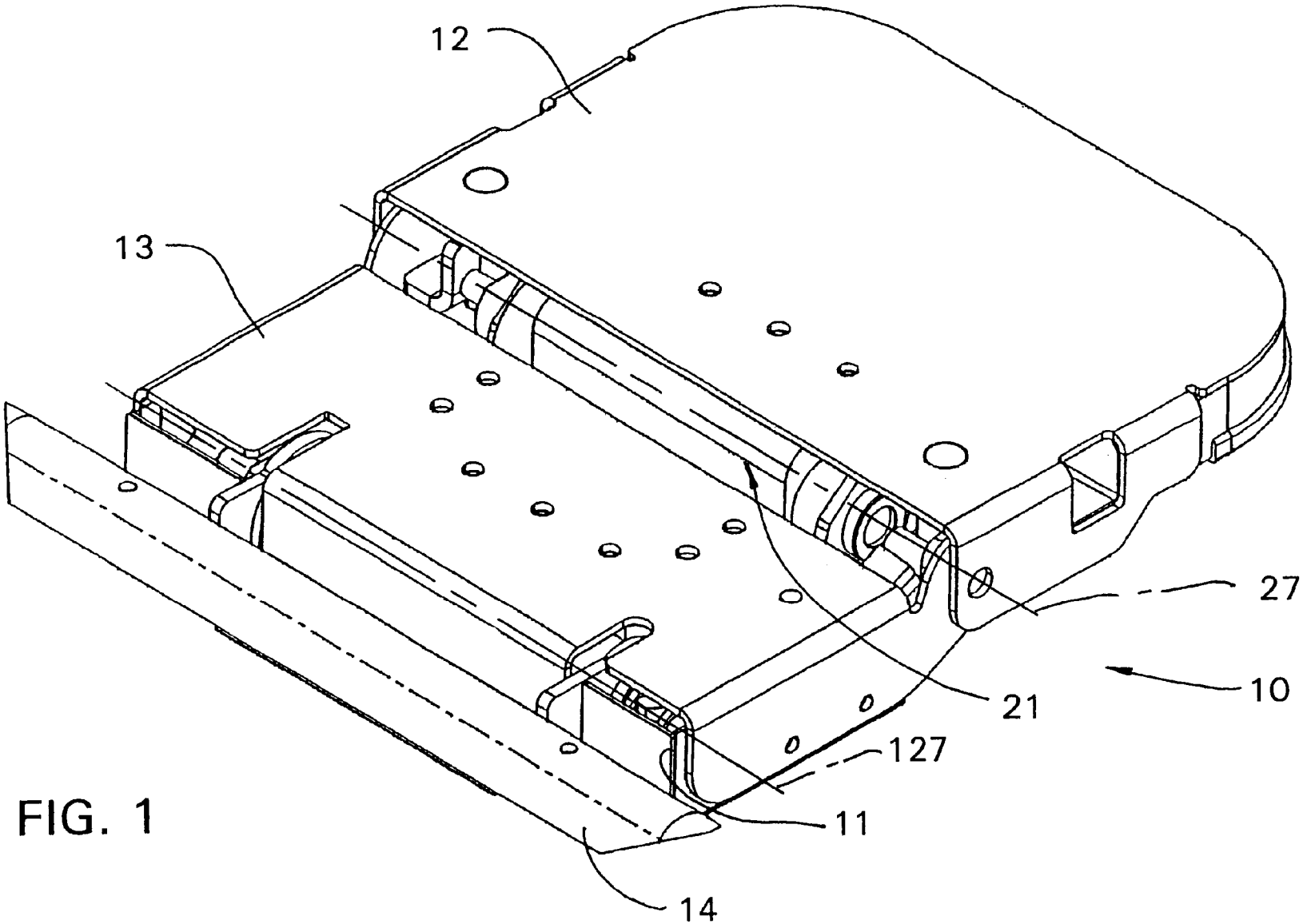
FIG. 1 is an elevated isometric view of a headpiece for patient support according to the present invention.

Referring to FIG. 1, there is illustrated a headpiece 10 for patient support according to the present invention. The headpiece includes a frame 11. Attached to the frame 11 are a head support plate 12 and a neck support plate 13. The head support plate 12 is pivotally attached to the neck support plate 13. The neck support plate 13 is configured for pivotal attachment to a surgical table (not shown) by a bracket 14.

Figure 3:
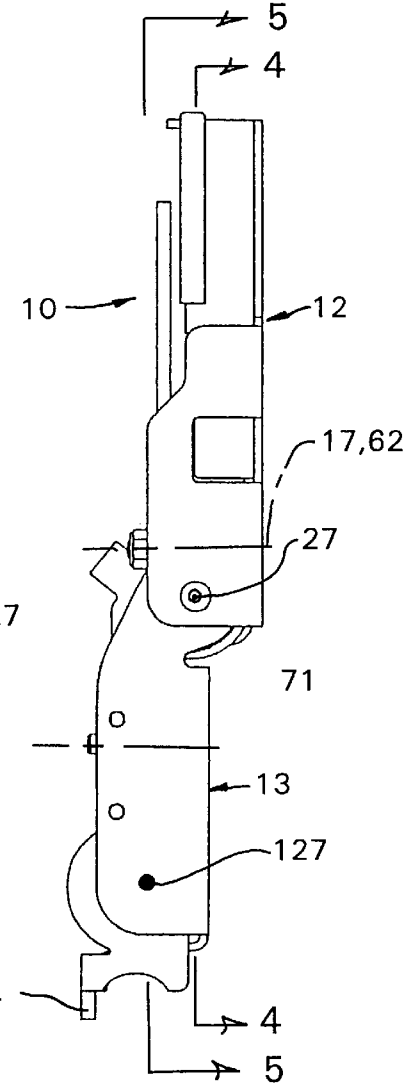
FIG. 3 is a side view of the headpiece of FIG. 1.
Figure 2:
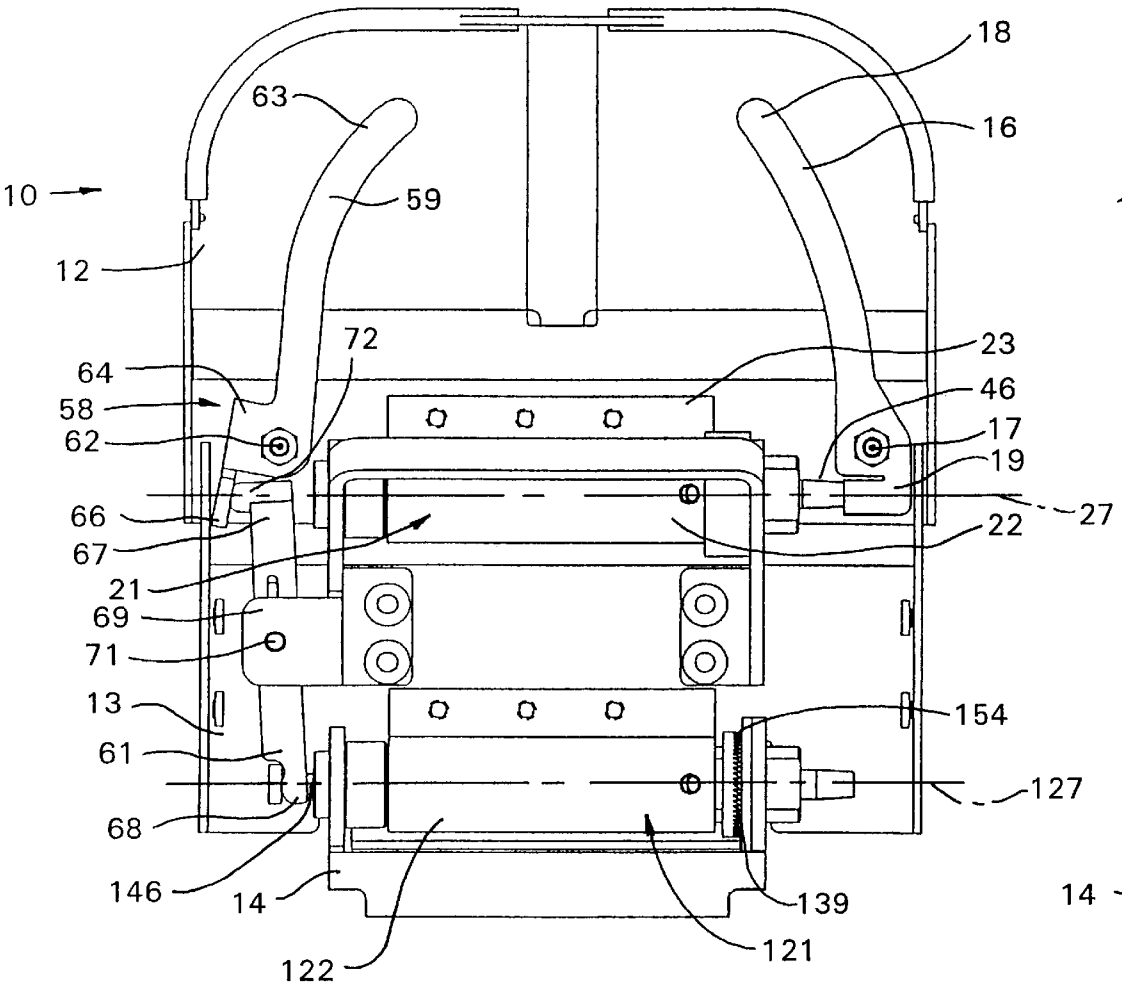
FIG. 2 is a bottom view of the headpiece of FIG. 1.

Referring now in addition to FIGS. 2 and 3, bottom and side views of the various components of the headpiece 10 are shown. The headpiece 10 includes a first lever 16 that is attached to the head support plate 12. The first lever 16 is pivotal with respect to the head support plate 12 about a pivot axis 17 between a first position, illustrated in FIG. 2, and a second position, not shown. The first lever has a first, free end 18 and a second end 19 that is adjacent the pivot axis 17.

Figure 4:
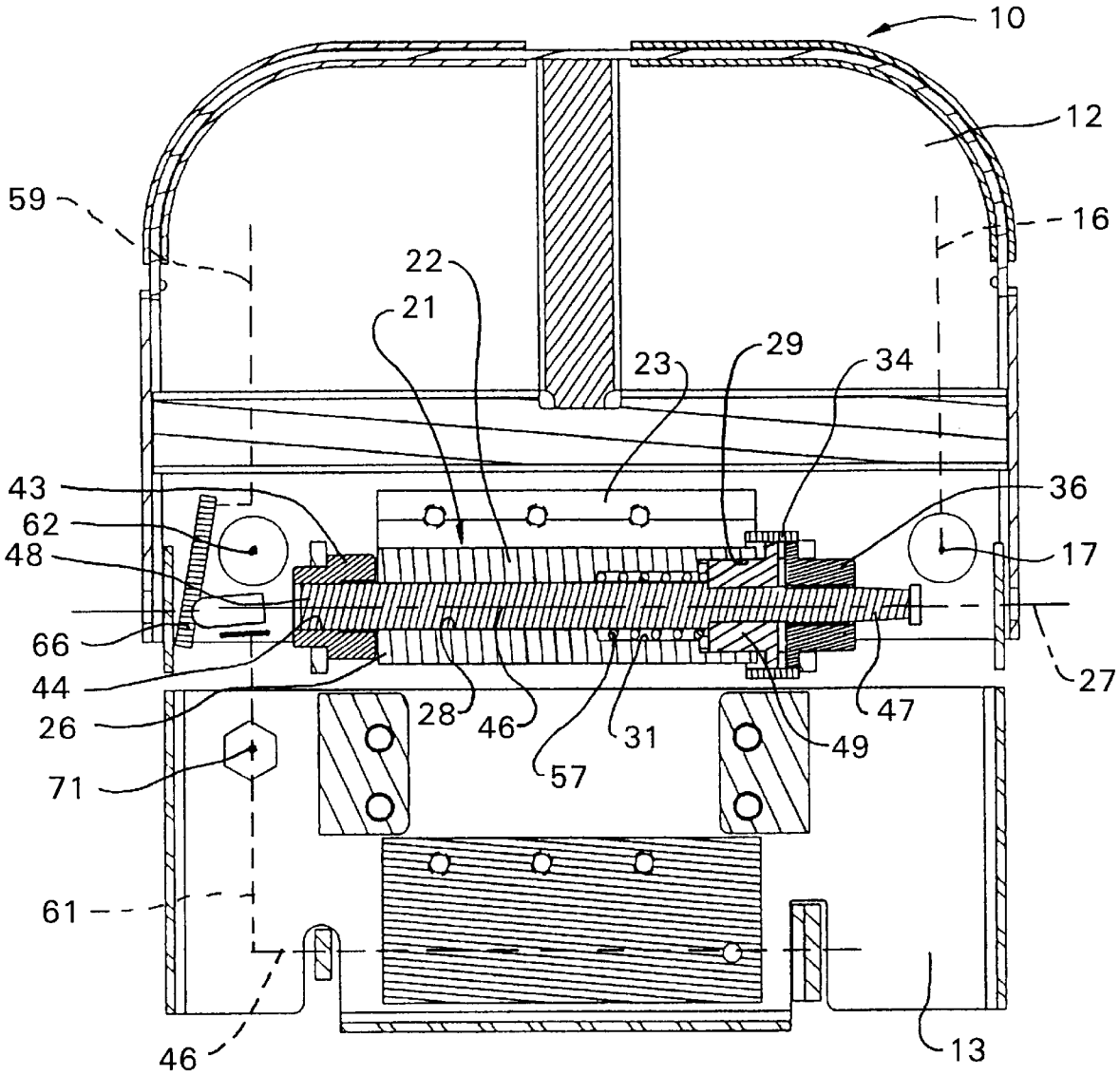
FIG. 4 is a cross-sectional bottom view of the headpiece of FIG. 1 through the section lines IV—IV of FIG. 3.
Figure 4A:
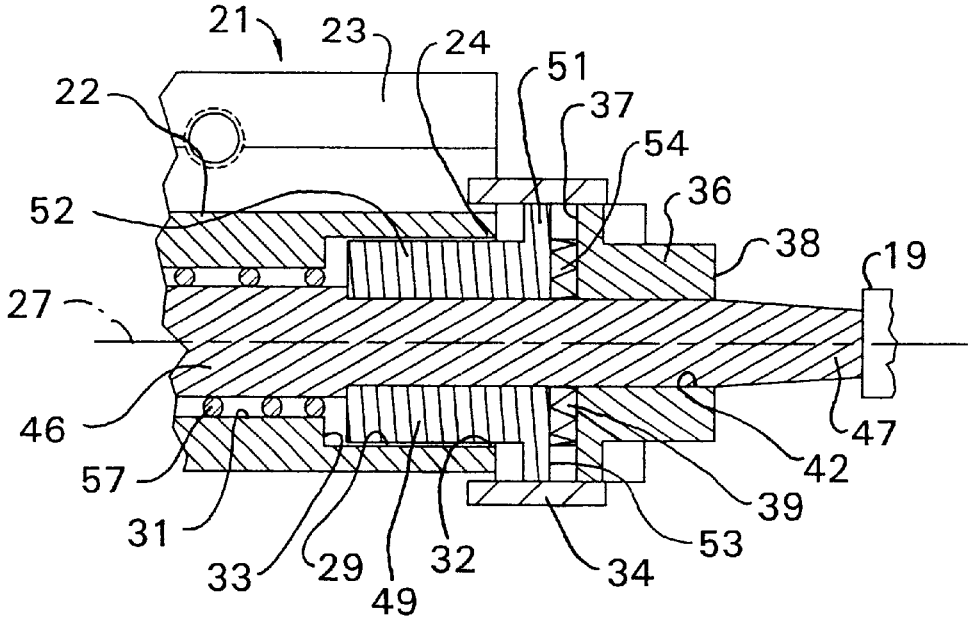
FIG. 4*a* is an enlarged cross-sectional bottom view of the first end of the first locking mechanism illustrated in FIG. 4.

A first locking mechanism 21 is attached to the head support plate 12. Referring to FIG. 4, the first locking mechanism 21 includes a hollow tubular member 22 that is attached to the head support plate 12 by a bracket 23. The tubular member 22 has a first end 24 spaced apart from a second end 26 along a longitudinal axis 27. A passage 28 extends through the tubular member 22 along the longitudinal axis 27. First and second cavities 29 and 31 are formed in the tubular member 22 and extend along the longitudinal axis 27. The first cavity 29 is formed adjacent the first end 24 and has a diameter greater than the diameter of the passage 28. The first cavity 29 has a first end 32 that is adjacent the first end 24 of the tubular member 22 and a second end 33 that is spaced apart from the first end 32. The second cavity 31 extends from the second end 33 of the first cavity 29 toward a midsection of the tubular member 22. The diameter of the second cavity 31 is greater than the diameter of the passage 28, but less than the diameter of the first cavity 29. Thus, as illustrated, the passage 29 opens into the second cavity 31, which opens into the first cavity 29.

A sleeve 34 is fitted around the first end 24 of the tubular member 22. A first end piece 36 is rigidly attached to the sleeve 34. The first end piece 36 has an inner-facing surface 37 adjacent the tubular member 22 and an outer-facing surface 38 in opposition to the inner-facing surface 37. A series of teeth 39 are spaced about the circumference of the inner-facing surface 37. The teeth 39 preferably extend outward from the inner-facing surface 37 at an angle and therefore are not parallel with a side surface of the first end piece 36. A bore 42 extends through the first end piece 36 and is axially aligned with the passage 28 formed in the tubular member 22. A second end piece 43 is rigidly attached to the second end 26 of the tubular member 22. A recess 44 is formed in the second end piece 43 adjacent the second end 26 of the tubular member 22 and is axially aligned with the passage 28 and the bore 42.

A rod 46 is slidably positioned in the passage 28 of the tubular member 22 and has an axis that extends congruently with the longitudinal axis 27. A first end 47 of the rod 46 extends through the bore 42 in the first end piece 36 and a second end 48 of the rod 46 extends into the recess 44 in the second end piece 43. The first end 47 of the rod 46 is attached to the second end 19 of the first lever 16. Thus, when the first lever 16 pivots about the pivot axis 17, the rod 46 will slide with respect to the tubular member 22 and the end pieces 36 and 43 between an advanced position, illustrated in FIG. 4, and a retracted position, not illustrated. Since the rod 46 is attached to the first arm 16 along the longitudinal axis 27, the first arm 16 exerts a direct force on the rod 46 to move the rod between its advanced and retracted positions. This connection results in a smooth movement of the rod 46 along the longitudinal axis 27.

A collar 49 is threadably attached to the rod 46 between the first end 47 and a midsection of the rod 46. The collar 49 is at least partially positioned in the first cavity 29. The collar 49 has a first portion 51 positioned outside of the tubular member 22 and a reduced diameter portion 52 that is at least partially positioned in the first cavity 29. The collar 49 can slide within the first cavity 29 between advanced and retracted positions when the rod 46 slides between its advanced and retracted positions. The first portion 51 of the collar 49 has an outer facing surface 53 that includes a series of teeth 54. The teeth 54 extend axially outward from the collar 49 at an angle and therefore are not parallel with a side surface of the collar 49. The teeth 54 are sized and configured to intermesh with the teeth 39 extending from the first end piece 36 when the collar 49 is in its advanced position. When the collar 49 is in its retracted position, the teeth 54 are out of contact with the teeth 39 of the first end piece 36. Therefore, the first cavity 29 and the reduced diameter portion 52 should be sized so the teeth 54 are out of contact with the teeth 39 of the first end piece 36 when the collar 49 is in its retracted position. When the teeth 54 are out of contact with the teeth 39 of the first end piece 36, the first locking mechanism is in a release position and the head support plate 12 can pivot about the longitudinal axis 27. When the teeth 54 are interlocked with the teeth 39 of the first end piece 36, the first locking mechanism 21 is in a locked position and the head support plate 12 is prevented from pivoting about the longitudinal axis 27. A spring 57 is positioned in the second cavity 31 of the tubular member 22 around the rod 46. The spring 57 continuously urges the collar 49 toward its advanced position.

Figure 6:
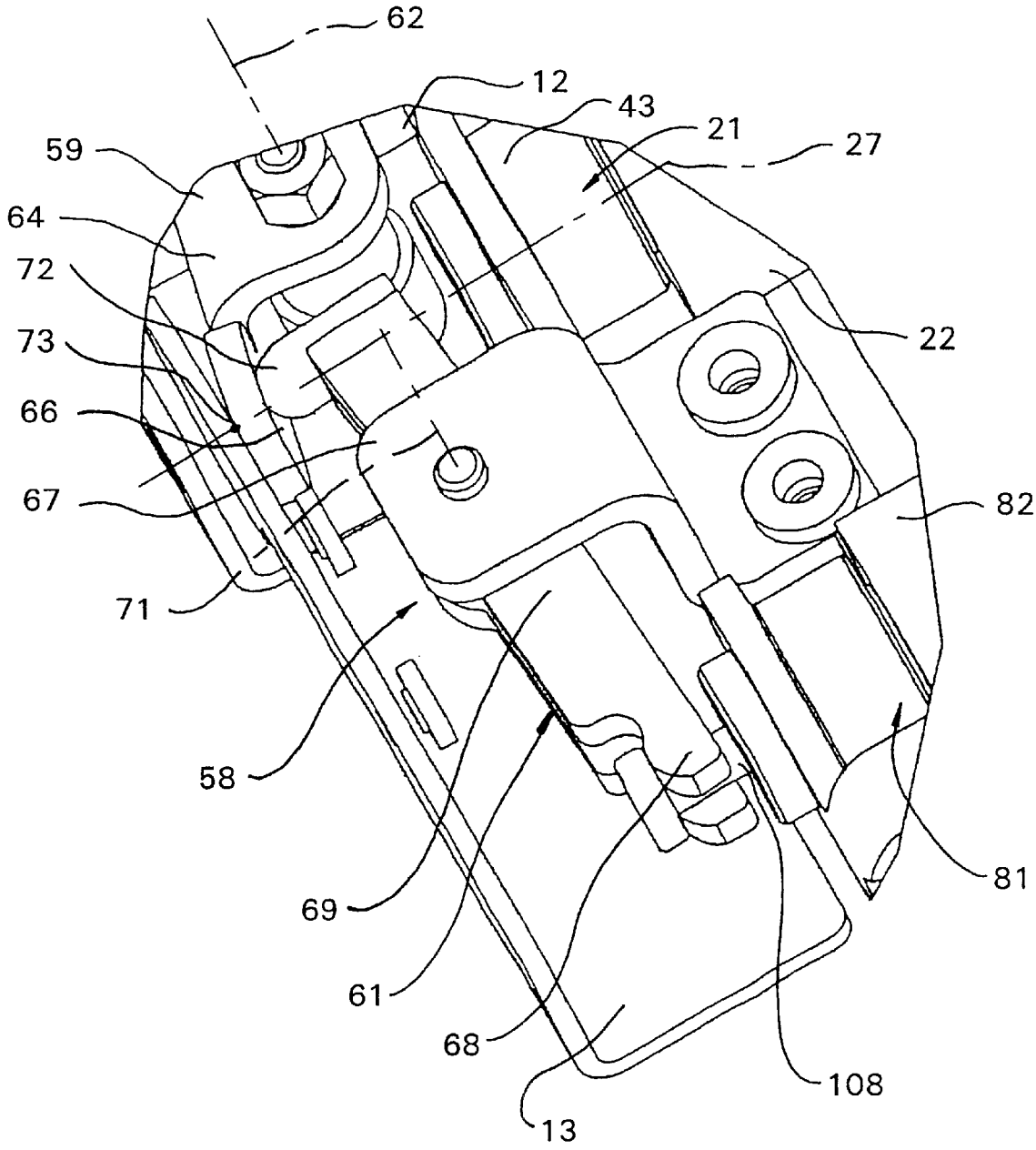
FIG. 6 is an enlarged isometric view of the juncture of the first and second arms of the second lever of the headpiece of FIG. 1.

Returning to FIG. 2, the headpiece 10 also includes a second lever 58. The second lever 58 has a first arm 59 that is attached to the head support plate 12 and a second arm 61 that is attached to the neck support plate 13. The first arm 59 is pivotal about a pivot axis 62 and has a first, free end 63 and a second end 64 that is adjacent the pivot axis 62. A flange 66 extends upward from the second end 64 toward the head support plate 12. The second arm 61 has a first end 67 adjacent the second end 64 of the first arm 59 and a second end 68 that is spaced apart from the first end 67 by a central portion 69. The second arm 61 can pivot about a pivot axis 71 that extends through the central portion 69. A tab 72 extends outward from the first end 67 of the second arm 61 toward the flange 66 of the first arm 59. As best illustrated in FIG. 6, the tab 72 contacts the flange 66 at a contact point 73 along the longitudinal axis 27 of the tubular member 22. Since the contact point 73 is along the longitudinal axis 27, the tab 72 will not scrape across the surface of the flange 66 when the head support plate 12 pivots with respect to the neck support plate 13.

Figure 5A:
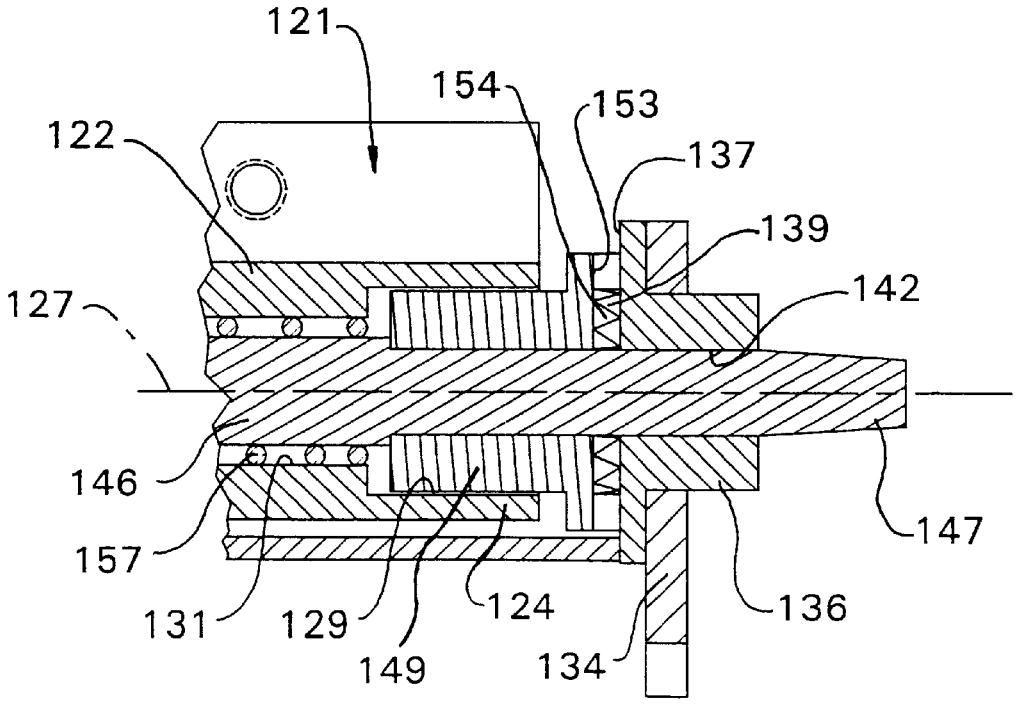
FIG. 5*a* is an enlarged cross-sectional bottom view of the first end of the second locking mechanism illustrated in FIG. 5.
Figure 5:
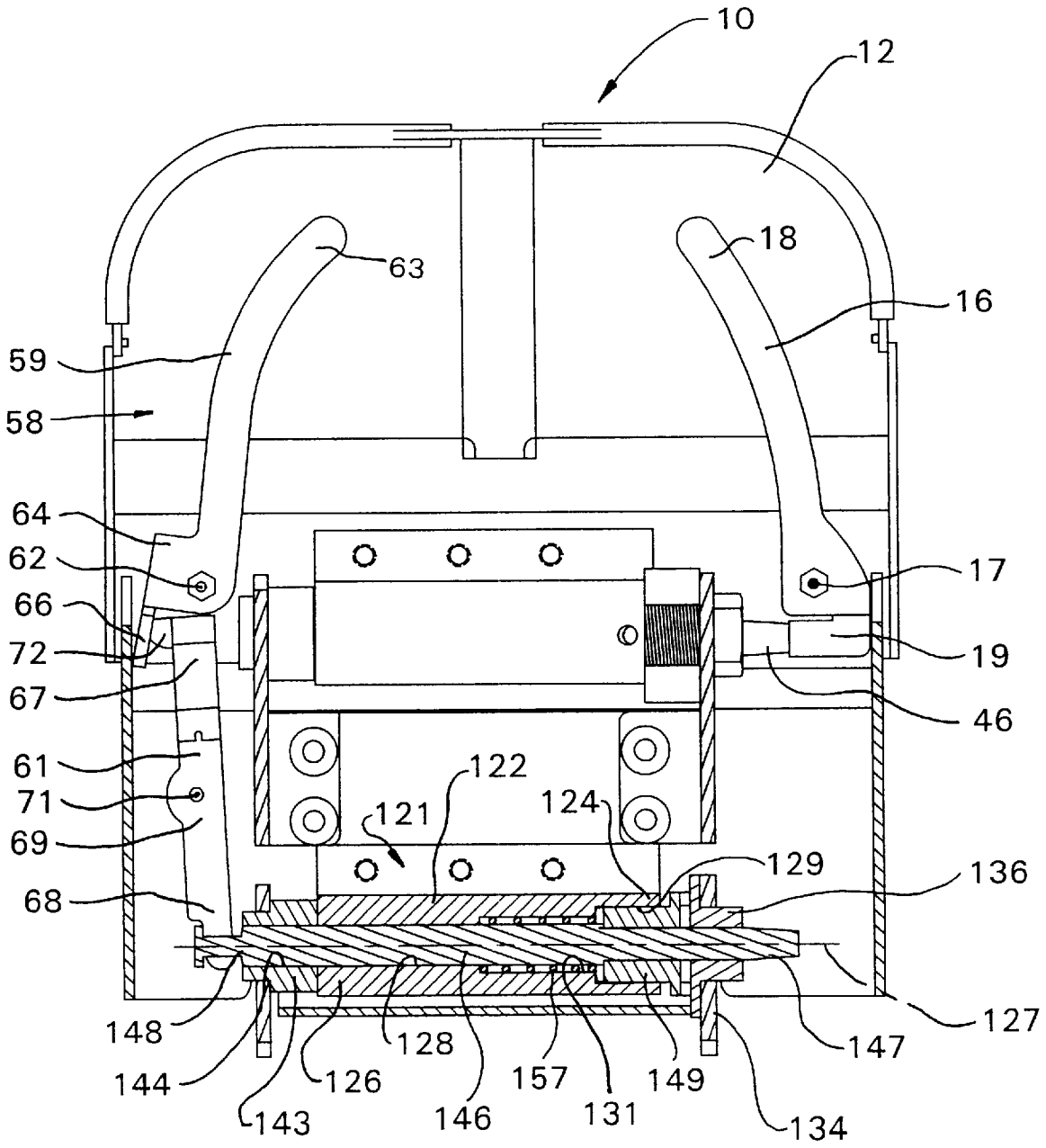
FIG. 5 is a cross-sectional bottom view of the headpiece of FIG. 1 through the section lines V—V of FIG. 3.

A second locking mechanism 81 is attached to the neck support plate 13. Referring in addition to FIG. 5, the second locking mechanism 81 is virtually identical to the first locking mechanism 21. For continuity, those components that are similar, or identical, to features described previously have been labeled with the feature numbers 121–157, corresponding to the feature numbers for the first locking mechanism 21, which were between 21 and 57.

The second locking mechanism 121 includes a hollow tubular member 122 having first and second ends 124 and 126 spaced apart along a longitudinal axis 127. A passage 128 extends through the tubular member 122 and is axially aligned with the longitudinal axis 127. A first cavity 129 is formed in the first end 124 of the tubular member 122 and a second cavity 131 is formed in the tubular member 122 between the first cavity 129 and a midsection of the tubular member 122. The bracket 14 includes a sleeve 134 that fits over the first end 124 of the tubular member 122. A first end piece 136 is rigidly attached to the sleeve 134 and has an inner-facing surface 137 including a series of teeth 139. A bore 142 extends through the first end piece 136 and is axially aligned with the passage 128 in the tubular member 122. A second end piece 143 is attached to a second end 126 of the tubular member 122. A bore 144 extends through the second end piece 143 and is axially aligned with the passage 128 and the bore 142 along the longitudinal axis 127.

A rod 146 is slidably positioned in the passage 128 and extends along the longitudinal axis 127. A first end 147 of the rod 146 extends through the bore 142 in the first end piece 136 and a second end 148 of the rod 146 extends through the bore 144 in the second end piece 143. The first end 147 of the rod 146 is attached to the second end 68 of the second arm 61 of the second lever 58. When the second arm 61 pivots about the pivot axis 71, the rod 146 will slide between an advanced position, illustrated in FIG. 5, and a retracted position, not illustrated. As with the attachment between the first lever 16 and the rod 46, the rod 146 is attached to the second arm 61 of the second lever 58 along the longitudinal axis 127. This direct attachment along the longitudinal axis 127 will allow for smooth, even movement of the rod 146 when the second arm 61 pivots. A collar 149 is threadably attached near the first end 147 of the rod 146 and is at least partially positioned in the first cavity 129. The collar 149 can slide within the first cavity 129 between advanced and retracted positions when the rod 146 slides between its advanced and retracted positions. A series of teeth 154 on an outer-facing surface 153 of the collar 149 are configured to intermesh with the teeth 139 on the first end piece 136 when the collar 149 is in its advanced position. When the collar 149 is in its retracted position, the teeth 154 are out of contact with the teeth 139 of the first end piece 136. When the teeth 154 are out of contact with the teeth 139 of the first end piece 136, the second locking mechanism is in a release position and the neck support plate 13 can pivot with respect to the bracket 14 about the longitudinal axis 127. When the teeth 154 are interlocked with the teeth 139 of the first end piece 136, the second locking mechanism is in a locked position and the neck support plate 13 is prevented from pivoting about the longitudinal axis 127. A spring 157 is positioned in the second cavity 131 of the tubular member 122 and surrounds the rod 146. The spring 157 continuously urges the collar 149 toward its advanced position.

OPERATION

To adjust the orientation of a patient's head and/or neck for surgery, a respective one of the levers 16 and 58 is pulled by a member of the surgical team to move the head support plate 12 and/or the neck support plate 13 to the desired position. To adjust the orientation of the patient's head relative to his or her neck, the position of the head support plate 12 is changed. To alter the position of the head support plate 12, the first lever 16 is pulled so that it pivots from its first, illustrated position to its second position. When the first lever 16 pivots, the second end 19 is moved toward the first locking mechanism 21 along the longitudinal axis 27. The rod 46, which is attached to the second end 19 of the first lever 16, slides within the passage 28 of the tubular member 22. As the rod 46 slides, the collar 49 retracts from its biased, advanced position to its retracted position against the urging of the spring 57. As the collar 49 moves away from its advanced position, the teeth 54 of the collar 49 are disengaged from the teeth 39 of the first end piece 36.

Once the teeth 54 of the collar 49 disengage from the teeth 39 of the first end piece 36, the head support plate 12 is no longer locked in a fixed position with respect to the neck support plate 13. The head support plate 12 can therefore be pivoted to the desired position about the longitudinal axis 27. When the head support plate 12 has been pivoted to the desired position, the first lever 16 is released. Since the rod 46 is no longer being pulled toward the second end 26 of the tubular member 22 by the first lever 16, the collar 49 is returned to its advanced position by the spring 57. The force of the spring 57 acting on the collar 49 causes the rod 46, which is attached to the collar 49, to be moved toward its advanced position. As the rod 46 advances, the first lever 16 is returned to its first position. As the collar 49 returns to its advanced position, the teeth 54 interlock with the teeth 39 on the first end piece 36 to lock the head support plate 12 in the adjusted position. The head support plate 12 is now once again prevented from pivoting with respect to the neck support plate 13.

To re-orient the neck of a patient relative to his or her body, the orientation of the neck support plate 13 is altered. To change the position of the neck support plate 13, the first arm 59 of the second lever 58 is pulled to move the second lever 58 from its first, illustrated position to its second position (not illustrated). When the first arm 59 is pulled, it pivots about the pivot axis 62, moving the flange 66 toward the tab 72. The flange 66 exerts a force on the tab 72, causing the second arm 61 to pivot about the pivot axis 71. When the second arm 61 pivots, the second end 68 moves away from the second locking mechanism 121 along the longitudinal axis 127. As the second end 68 of the second arm 61 moves away from the second locking mechanism 121, the rod 146 is pulled toward its retracted position. As the rod 146 retracts, the collar 149 is moved toward its retracted position against the urging of the spring 157. As the collar 149 moves away from its advanced position, the teeth 154 of the collar 149 disengage from the teeth 139 of the first end piece 136.

Once the teeth 154 of the collar 149 disengage from the teeth 139 of the first end piece 136, the neck support plate 13 can pivot with respect to the bracket 14, and therefore the surgical table (not shown), about the longitudinal axis 127. When the neck support plate 13 is re-oriented to the desired position, the first arm 59 of the second lever 58 is released. When the first arm 59 is released, the force exerted on the tab 72 of the second arm 61 by the flange 66 of the first arm 59 is reduced to zero. With no force exerted on the second arm 61, the rod 146 is no longer urged toward its retracted position. The collar 149 is therefore returned to its advanced position by the spring 157. The force of the spring 157 acting on the collar 149 causes the rod 146 to return to its advanced position. As the collar 149 returns to its advanced position, the teeth 154 interlock with the teeth 139 on the first end piece 136 to lock the neck support plate 13 in the newly adjusted position. The neck support plate 13 is once again locked and prevented from pivoting about the longitudinal axis 127 with respect to the bracket 14 and the surgical table.

It should be appreciated that the foregoing description is for the purposes of illustration only, and further alternative embodiments of this invention are possible without departing from the scope of the claims. For instance, while the patient support headpiece has been described for use with a surgical table in an operating room setting, it should be appreciated that it could be used in any medical setting where adjustment of the patient's head and/or neck is desired.

Thus, although particular preferred embodiments of the present invention have been disclosed in detail for illustrative purposes, it will be recognized that variations or modifications lie within the scope of the present invention and do not depart from the spirit of the invention, as set forth in the foregoing description and drawings, and in the following claims.

What is claimed is:

1. A headpiece for providing support to the head of a patient comprising:

a neck support plate and a head support plate, said neck support plate having a first end configured for pivotal attachment to a surgical table and for movement about a neck support plate pivot axis and a second end that is pivotally attached to said head support plate so that said head support plate is pivotal with respect to said neck support plate about a head support plate pivot axis;

a first lever pivotally attached to said head support plate and configured to pivot about a first pivot axis between a first position and a second position;

a first locking mechanism configured for movement between locked and released positions, said first locking mechanism being configured to move to said locked position when said first lever is in said first position and to said released position when said first lever is in said second position;

said head support plate being configured to be fixed with respect to said neck support plate when said first locking mechanism is in said locked position, said head support plate additionally being configured to be pivotable with respect to said neck support plate about said head support plate pivot axis when said first locking mechanism is in said released position;

a second lever which includes a first arm that is pivotally attached to said head support plate for pivotal movement about a second pivot axis between third and fourth positions and a second arm that is pivotally attached to said neck support plate for pivotal movement about a third pivot axis between fifth and sixth positions, said first arm also being pivotal with respect to said second arm in response to pivoting of said head support plate about said head support plate pivot axis;

said first arm having a first distal end oriented intermediate said second and third pivot axes;

said second arm having a second distal end adjacent said first distal end and configured to engage said first distal end so that said second arm will pivot about said third pivot axis when said first arm pivots about said second pivot axis;

a second locking mechanism configured for movement between locked and released positions, said second locking mechanism being configured to move to said locked position when said second arm is in said fifth position and to said release position when said second arm is in said sixth position;

a second end of said second arm being connected to said second locking mechanism and being oriented congruently with said neck support plate pivot axis; and said neck support plate being configured to be fixed with respect to said surgical table when said second locking mechanism is in said locked position and said neck support plate additionally being configured to be pivotable about said neck support plate pivot axis when said second locking mechanism is in said released position.

2. The headpiece according to claim 1, wherein said first and second distal ends engage at a location that is congruent with said head support plate pivot axis.

3. The headpiece according to claim 1, wherein said first distal end includes a flange and said second distal end includes a tab, said tab and said flange contacting one another at a location closely adjacent said head support plate pivot axis.

4. The headpiece according to claim 1, wherein said second end of said second arm is oriented to intersect with said neck support plate pivot axis.

* * * * *